US011581675B2

(12) United States Patent
Hwang et al.

(10) Patent No.: US 11,581,675 B2
(45) Date of Patent: Feb. 14, 2023

(54) ELECTRICAL CONTACT

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Tzu-Yao Hwang, New Taipei (TW); Ming-Lun Szu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/144,146

(22) Filed: Jan. 8, 2021

(65) Prior Publication Data

US 2021/0210886 A1 Jul. 8, 2021

(30) Foreign Application Priority Data

Jan. 8, 2020 (CN) ..... 202010018130.3

(51) Int. Cl.
*H01R 13/24* (2006.01)
*H01R 12/71* (2011.01)
*H01R 12/70* (2011.01)

(52) U.S. Cl.
CPC ..... *H01R 13/2407* (2013.01); *H01R 12/7082* (2013.01); *H01R 12/712* (2013.01); *H01R 13/2464* (2013.01)

(58) Field of Classification Search
CPC ..... H01R 12/714; H01R 13/2435; H01R 13/2442; H01R 12/57; H01R 12/52;
(Continued)

(56) References Cited

U.S. PATENT DOCUMENTS 4,998,886 A * 3/1991 Werner ..... H01R 13/2428 439/631
5,498,166 A * 3/1996 Rothenberger .... H01R 13/5202 439/66

(Continued)

FOREIGN PATENT DOCUMENTS

CN 208157699 U 11/2018
TW M303515 12/2006

*Primary Examiner* — Briggitte R. Hammond
(74) *Attorney, Agent, or Firm* — Ming Chieh Chang

(57) ABSTRACT

An electrical contact for use with an electrical connector includes a conducting part and a supporting part wherein the conducting part has a better conduction characteristic than the supporting part while the supporting part has a better resiliency/strength characteristic than the conducting part. The conducting part includes a main body, an upper contacting arm extending upwardly from the main body and a lower contacting arm extending downwardly from the main body. The supporting part includes a secondary body, an upper supporting arm upwardly extending from the secondary body and a lower supporting arm downwardly extend from the secondary body. The main body and the secondary body are engaged together securely. The end of the upper contacting arm and that of the upper supporting arm are coupled together and the end of the lower contacting arm and that of the lower supporting arm are coupled together.

20 Claims, 10 Drawing Sheets

(58) Field of Classification Search
CPC ..... H01R 12/7076; H01R 12/7082; H01R 12/716; H01R 13/41; H01R 13/2457; H01R 13/2492; H01R 13/2407; H01R 13/24; H01R 43/0256; H01R 12/73; H01R 13/428; H01R 13/03; H01R 13/2464; H01R 4/4809; H01R 4/024; H01R 13/50; H01R 13/46; H01R 13/26; H01R 13/2414; H01R 13/15; H01R 13/02; H01R 12/88; H01R 12/718; H01R 13/6473; H01R 13/6461; H01R 13/6315; H01R 13/514; H01R 13/502; H01R 13/422; H01R 4/02; H01R 43/16; H01R 12/707; H01R 12/58; H01R 13/2428; H01R 13/40; H01R 13/432; H01R 43/20; H01R 12/712; H01R 13/112; H01R 13/646; H01R 12/721; H01R 13/193; H01R 13/2485; H01R 33/74; H01R 13/6474; H01R 12/585; H01R 13/17; H01R 13/2421; H01R 13/245; H01R 12/55; H01R 12/71; H01R 13/405; H01H 1/20; H01H 13/365; H01H 13/36; H01H 50/56; H01H 1/50; H01H 5/18; H01H 1/26; H01H 50/546; H01H 50/54
USPC ..... 439/861, 862, 857; 200/408, 447, 238, 200/243, 246, 247, 251, 256
See application file for complete search history.

(56) References Cited

U.S. PATENT DOCUMENTS

| | | | | |
|---|---|---|---|---|
| 7,780,456 | B2 * | 8/2010 | Chen | H05K 7/1069 439/66 |
| 10,535,946 | B2 | 1/2020 | Ho et al. | |
| 10,573,620 | B2 * | 2/2020 | Dugal | H01L 25/11 |
| 10,658,775 | B2 * | 5/2020 | Lin | H01R 12/73 |
| 10,797,424 | B2 * | 10/2020 | Hsu | H01R 12/7082 |
| 10,804,636 | B1 * | 10/2020 | Hsu | H01R 13/2442 |
| 11,056,815 | B2 * | 7/2021 | Hsu | H01R 13/24 |
| 2020/0220291 | A1 * | 7/2020 | Ho | H01R 13/2457 |
| 2020/0412037 | A1 * | 12/2020 | Hsu | H01R 13/2407 |
| 2021/0203097 | A1 | 7/2021 | Foxconn | |
| 2021/0218174 | A1 * | 7/2021 | Liao | H01R 13/2464 |

* cited by examiner

ELECTRICAL CONTACT

BACKGROUND OF THE INVENTION

1. Field of the Invention

The present invention relates to an electrical contact for use with an electrical connector connecting the CPU (Central Processing Unit) and the PCB (Printed Circuit Board), and particularly to the electrical contact essentially composed of two parts with different mechanical and electrical characteristics.

2. Description of Related Arts

China Patent No. CN208157699 discloses an electrical connector having a main body with opposite upper contacting arm and lower contacting for respectively connecting to the CPU and PCB wherein the free ends of the upper contacting arm and the lower contacting arm are connected together when the contact is in a compressed manner so as to result in the dual-path transmission between the CPU and PCB. Understandably, the contact is desired to have both the superior mechanical characteristic and electrical characteristic. Anyhow, a same material may not own both the mechanical resiliency characteristic and the electrical conduction characteristic.

Therefore, it is desired to provide an electrical connector with corresponding contacts not only having the dual-path transmission but also owning both superior mechanical and electrical characteristics.

SUMMARY OF THE INVENTION

To achieve the above object, an electrical contact for use with an electrical connector includes a conducting part and a supporting part wherein the conducting the part has a better conduction characteristic than the supporting part while the supporting part has a better resiliency/strength characteristic than the conducting part. The conducting part includes a main body, an upper contacting arm extending upwardly from the main body and a lower contacting arm extending downwardly from the main body. The supporting part includes a secondary body, an upper supporting arm upwardly extending from the secondary body and a lower supporting arm downwardly extend from the secondary body. The main body and the secondary body are engaged together securely. The end of the upper contacting arm and that of the upper supporting arm are engaged together while allowing a minor relative movement therebetween, and the end of the lower contacting arm and that of the lower supporting arm are engaged together while allowing a minor relative movement therebetween. Each of the conducting part and the supporting part provides both electrical and mechanical functions wherein the conducting part provides a shorter transmission path than the supporting part for electrical consideration while the supporting part provides a longer curved resiliency path than the conducting part for mechanical consideration.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
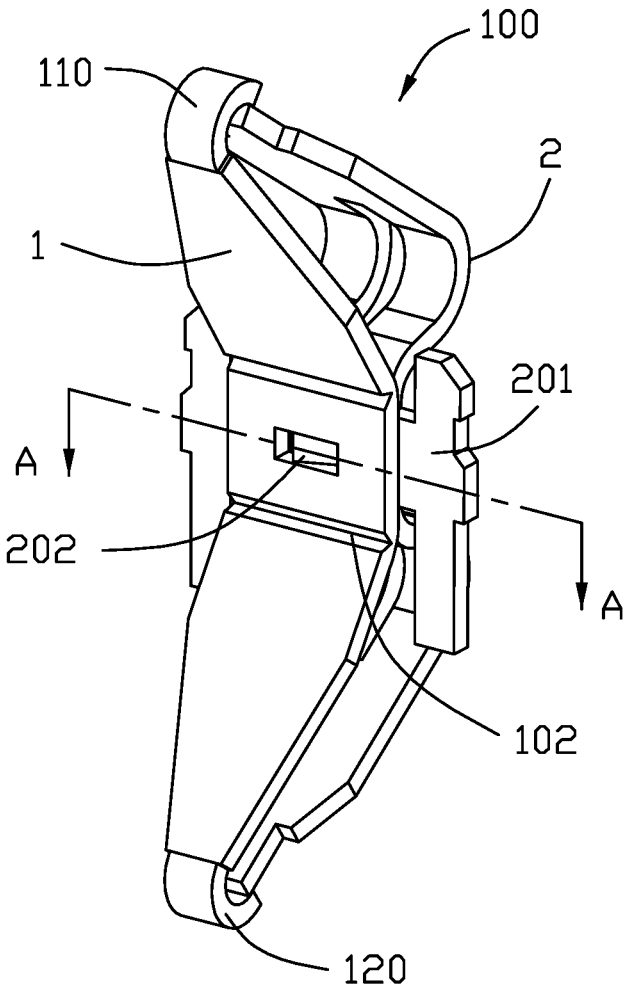
FIG. 1 is a perspective view of an electrical contact according to a first embodiment of the invention.
Figure 2:
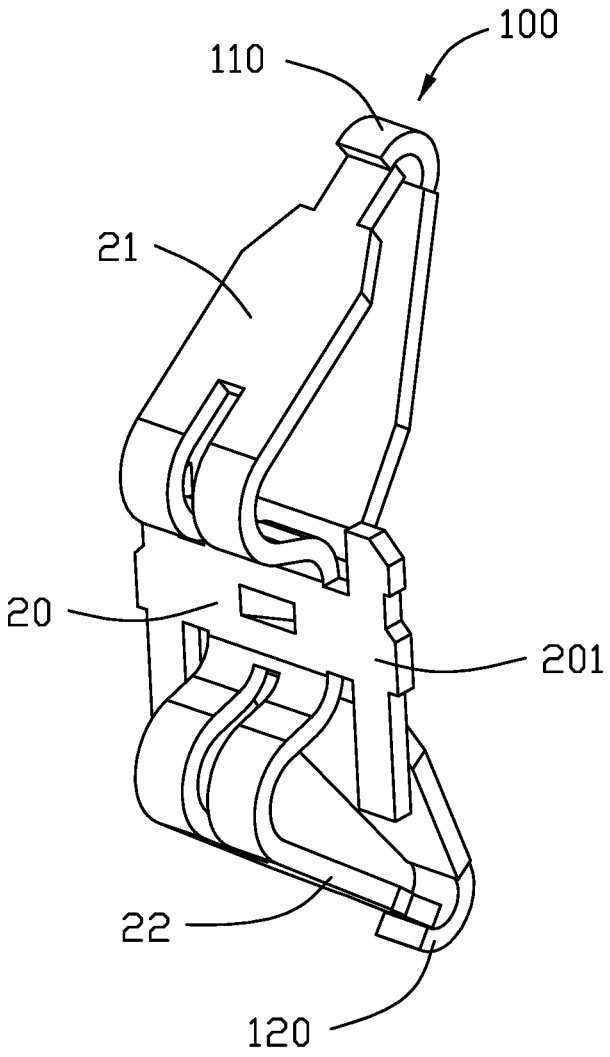
FIG. 2 is another perspective view of the electrical contact of FIG. 1.

Referring to FIGS. 1-6, the contact 100 for connecting between the CPU and the PCB, includes a conducting part 1 having better conductivity, and a supporting part 2 having better strength/resiliency. The conducting part 1 includes a main body 10, an upper contacting arm 11 extending upwardly and obliquely from an upper end of the main body 10, and a lower contacting arm 12 downwardly and obliquely from a lower end of the main body 10. The supporting part 12 includes a secondary body 20, an upper supporting arm 21 extending curvedly upwardly and obliquely from an upper end of the secondary body 20, and a lower supporting arm 22 extending curvedly downwardly and obliquely from a lower end of the secondary body 20. The main body 10 and the secondary body 20 are attached together. Both the upper supporting arm 21 and the lower supporting arm 22 extend with a check mark configuration in a mirror image so as to have the supporting part 2 have a W-like configuration in a side view. Differently, the conducting part 1 has a gutter like structure in a side view.

The upper contacting arm 11 includes an upper contacting section 110, for connecting the CPU, against which the end of the upper supporting arm 21 abuts. Similarly, the lower contacting arm 12 includes a lower contacting section 120, for connecting the PCB, against which the end of the lower supporting arm 22 abuts. Notably, the contacting section 110, 120 is essentially narrower than other portions of the contacting arm 11, 12 for impedance consistency consideration during mating, thus inevitably being weakened structurally. In this invention, the end of the supporting arm 21, 22 supportably abuts against the corresponding contacting section 110, 120 to resist the stress thereof for preventing structural yielding of the narrower contacting section 110, 120. The secondary body 20 forms barbs 201 on two lateral sides for retaining the contact 100 in the housing of the connector (not shown).

Figure 3:
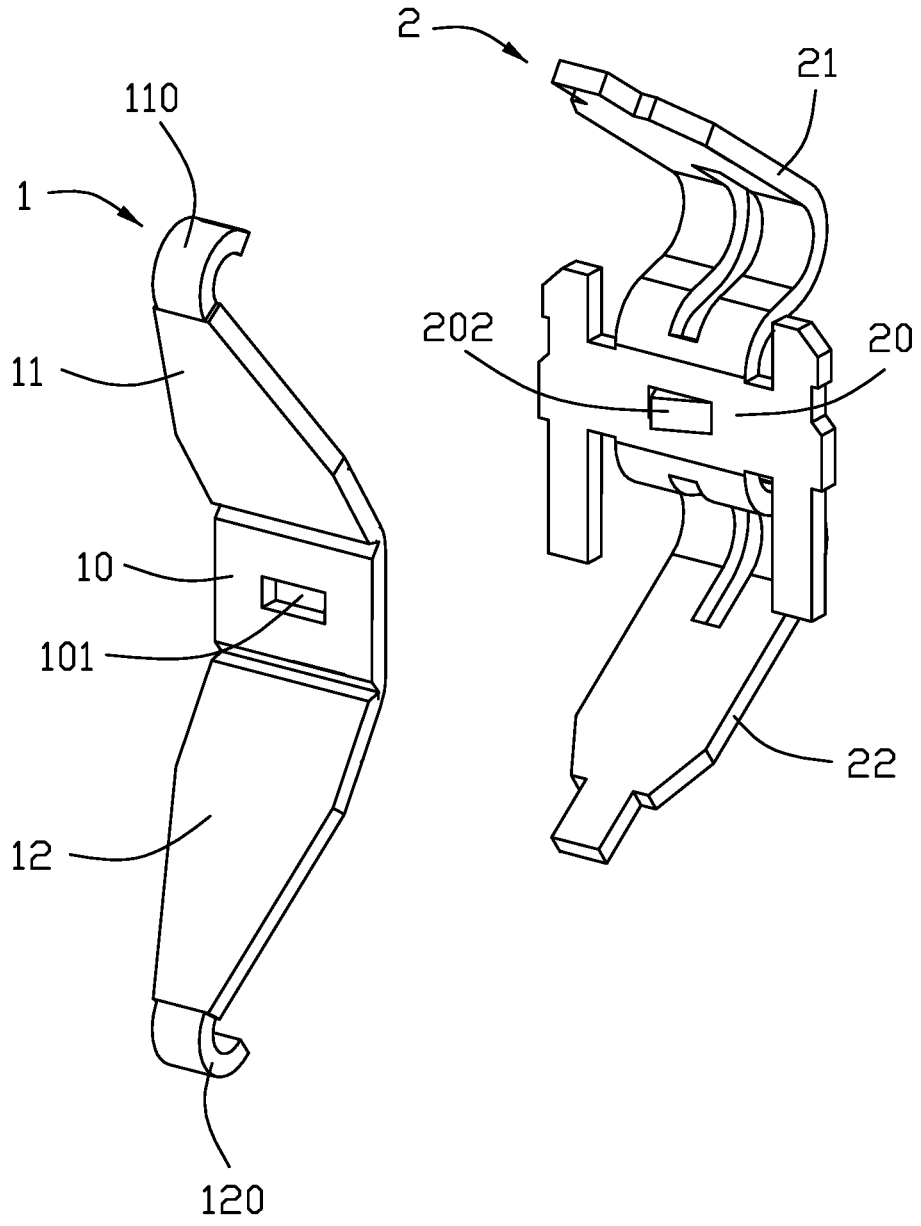
FIG. 3 is an exploded perspective view of the electrical contact of FIG. 1.
Figure 4:
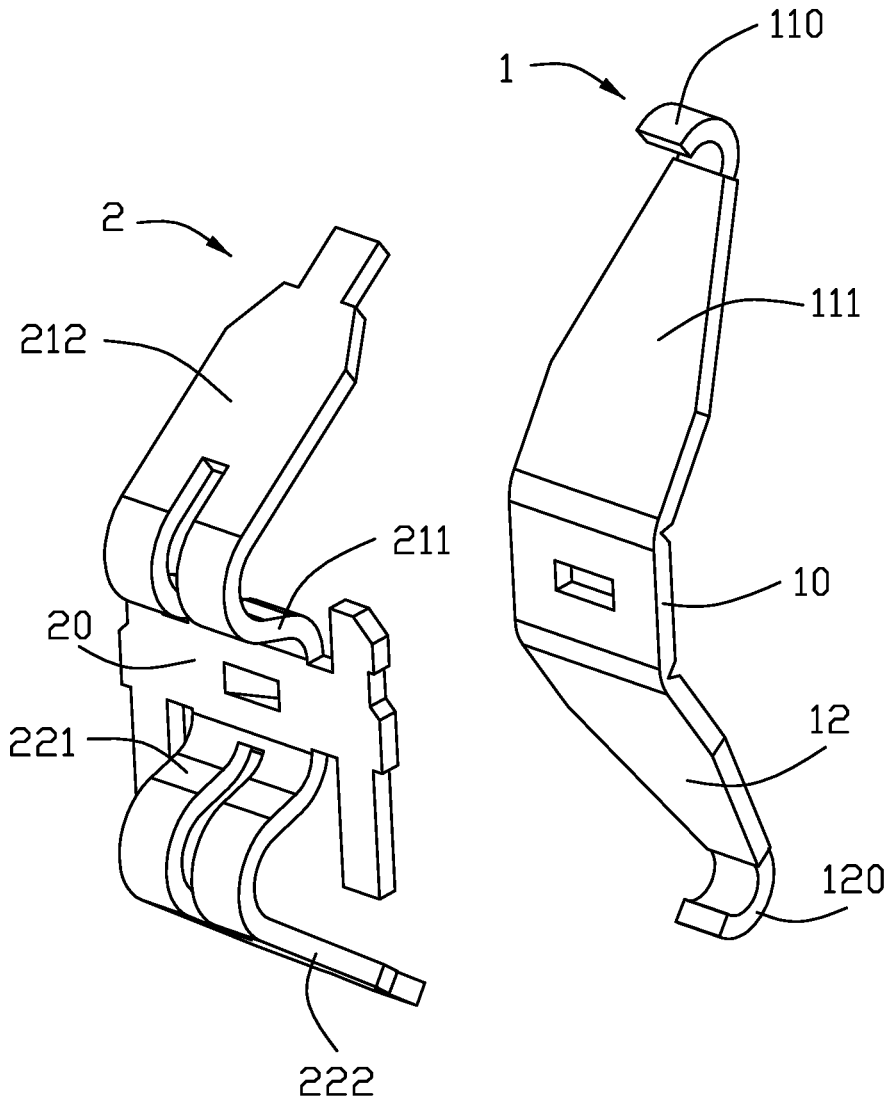
FIG. 4 is another exploded perspective view of the electrical contact of FIG. 3.
Figure 5:
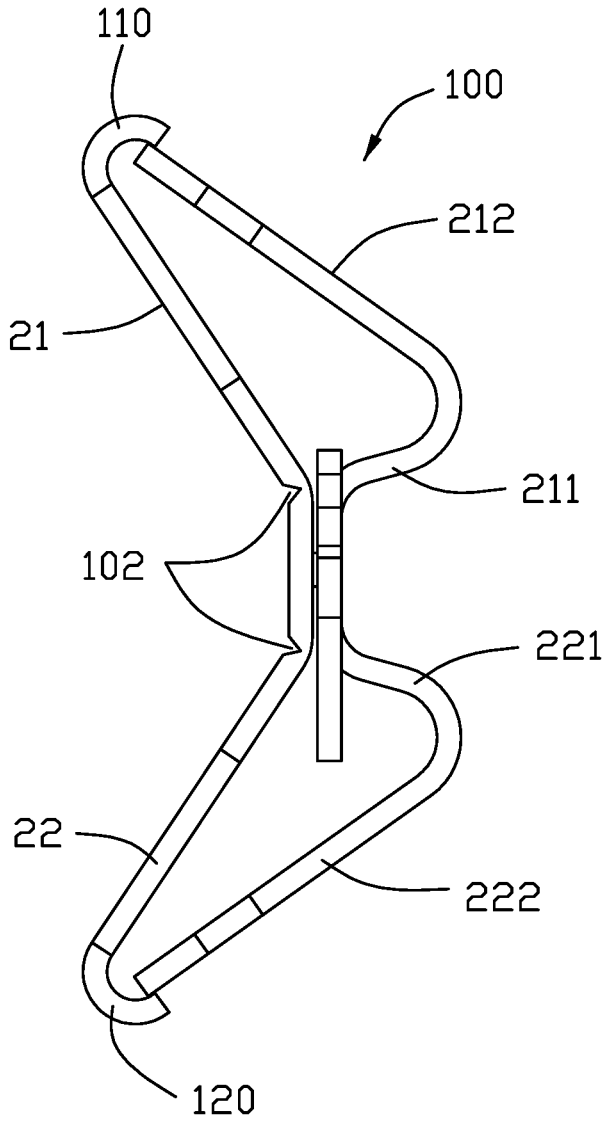
FIG. 5 is a side view of the electrical contact of FIG. 1.

Referring to FIGS. 3-5, the upper contacting arm 11 includes an oblique section 111 and the upper contacting section 110 extends backwardly from the end of the oblique section 111. Similarly, the lower contacting arm 12 includes an oblique section 121 and the lower contacting section 120 extends backwardly from the end of the oblique section 121. Therefore, the whole conducting part 1 has the aforementioned gutter like structure in a side view. Differently, the upper supporting arm 21 includes a first portion 211 extending in a first transverse direction and a second portion 212 extending in a second transverse direction opposite to the first direction. Similarly, the lower supporting arm 22 includes a first portion 221 extending in the first transverse direction and a second portion 222 extending in the second transverse direction. Therefore, the whole supporting part 2 has the aforementioned W like structure in the side view.

Figure 6:
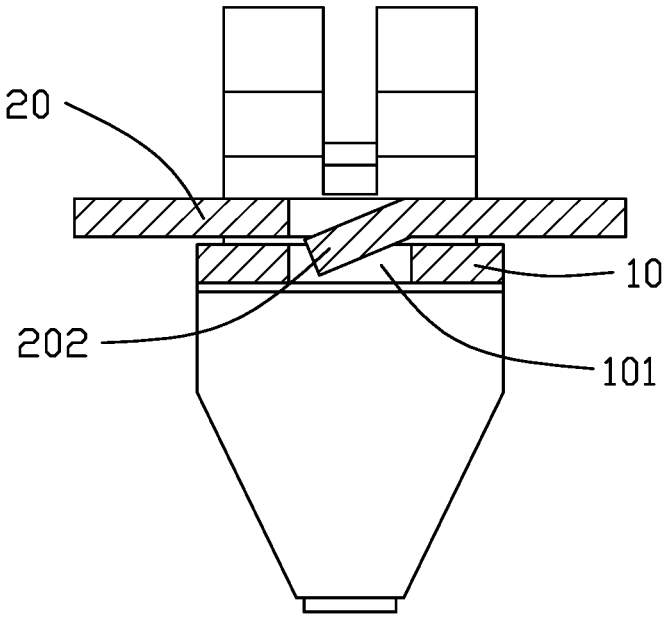
FIG. 6 is cross-sectional view of the electrical contact of FIG. 1.
Figure 7:
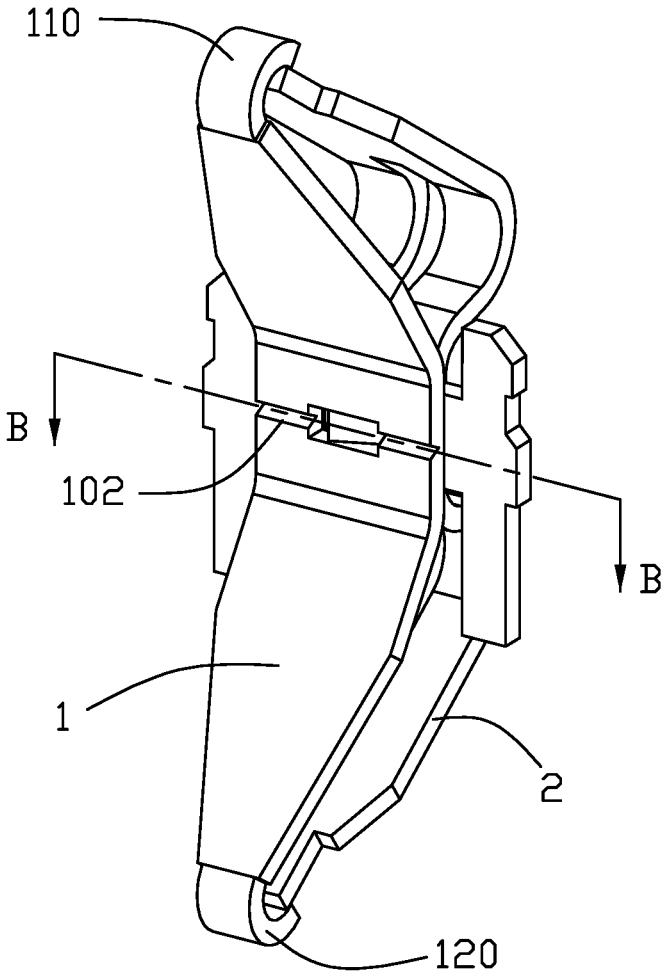
FIG. 7 is a perspective view of the electrical contact according to a second embodiment of the invention.
Figure 8:
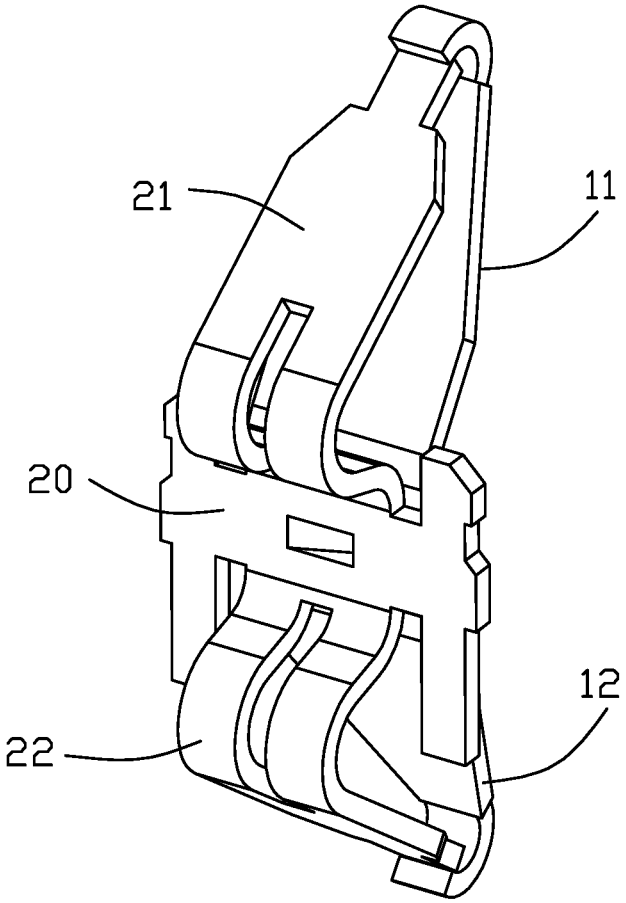
FIG. 8 is another perspective view of the electrical contact of FIG. 7.
Figure 9:
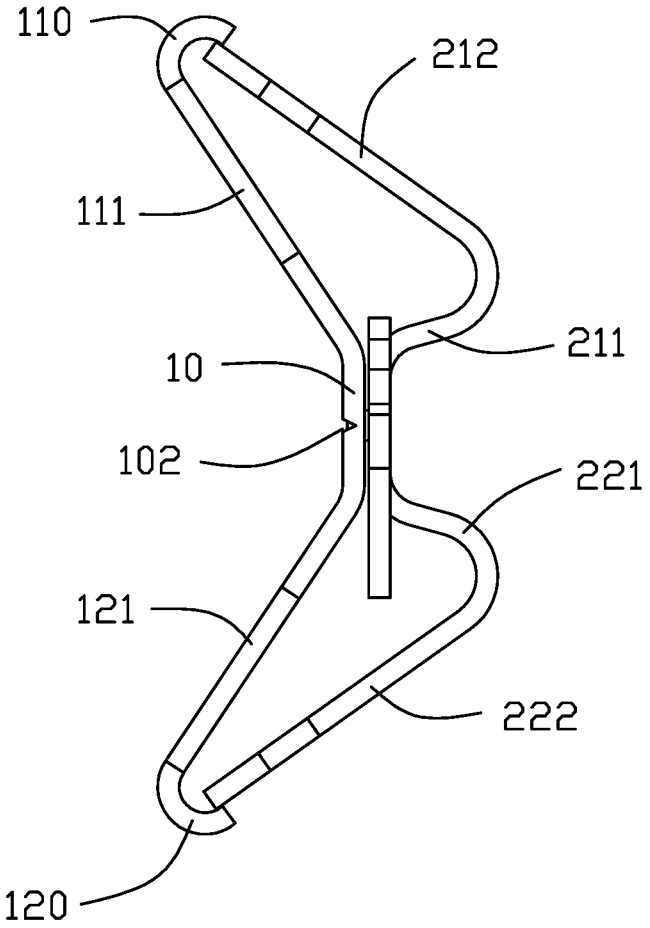
FIG. 9 is a side view of the electrical contact of FIG. 7.
Figure 10:
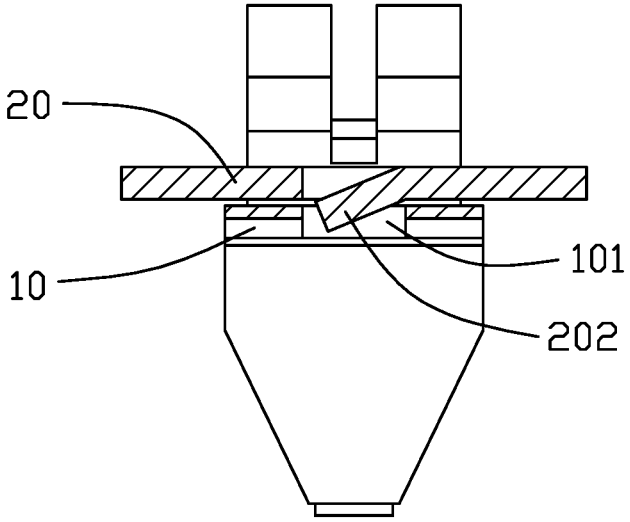
FIG. 10 is a cross-sectional view of the electrical contact of FIG. 7.

As shown in FIG. 6, the secondary body 20 forms a retaining block 202 to be received within the retaining hole 101 formed in the main body 10 so as to secure the conducting part 1 and the supporting part 2 together. As shown in FIG. 5, the main body 10 forms a plurality of V-grooves 102 for increasing resiliency thereof wherein the two V-grooves 102 are respectively located at conjunctions between the main body 10 and the contacting arms 11, 12, respectively in the first embodiment. Differently, as shown in FIG. 9, only one V-groove 102 may be formed in the middle of the main body 10 alternately in the second embodiment.

In brief, the hybrid type contact in the invention may provide both better electrical performance and mechanical performance by the relatively shorter transmission path, from the electrical viewpoint, derived from the conducting part 1 having the better conductivity thereof, and by the relatively longer deflection path, from the mechanical viewpoint, derived from the supporting part having the better strength/strength thereof.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical contact for use with an electrical connector, comprising:

a conducting part including a vertical main body with a resilient upper contacting arm upwardly extending from the main body with an upper contacting section at an upper end thereof; and a supporting part including a vertical secondary body abutting against the main body with a resilient upper supporting arm upwardly extending from the secondary body thereof with an upper end abutting against the upper contacting section; wherein the conducting part and the supporting part are made from different materials, and the conducting part has better conductivity than the supporting part while the supporting part has better strength and resiliency than the conducting part; and the upper contacting arm is shorter than the upper supporting arm in an extended manner.

2. The electrical contact as claimed in claim 1, wherein the upper end of the upper supporting arm abuts against the upper contacting section upwardly.

3. The electrical contact as claimed in claim 1, wherein the upper contacting arm extends from the main body in a first transverse direction while the contacting section extends backwardly in a second transverse direction opposite to the first transverse direction.

4. The electrical contact as claimed in claim 3, wherein the upper supporting arm includes a first portion extending from the secondary body in the second transverse direction, and a second portion extending from the first portion in the first transverse direction with the upper end thereof.

5. The electrical contact as claimed in claim 1, wherein the secondary body forms barbs for engagement within an insulative housing of the electrical connector while the main body does not.

6. The electrical contact as claimed in claim 1, wherein the conducting part forms a V-groove.

7. The electrical contact as claimed in claim 1, wherein the main body is engaged with the secondary body in a parallel relation.

8. The electrical contact as claimed in claim 1, wherein both the upper contacting arm and the upper supporting arm are deflected in a vertical direction during mating with an electronic package.

9. An electrical contact for use with an electrical connector, comprising:

a conducting part including a vertical main body with a resilient upper contacting arm extending upwardly from the main body and equipped with an upper contacting section at an upper end thereof, and a resilient lower contacting arm extending downwardly from the main body and equipped with a lower contacting section at a lower end thereof; and a supporting part including a vertical secondary body with a resilient upper supporting arm extending upwardly from the secondary body to supportably abut against the upper contacting arm, and a resilient lower supporting arm extending downwardly from the secondary body to supportably abut against the lower contacting arm; wherein the conducting part and the supporting part are made from different materials, and the conducting part has better conductivity than the supporting part while the supporting part has better strength and resiliency than the conducting part; and both the conducting part and the supporting part establish electrical transmission paths and mechanical deflection paths, and the electrical transmission path defined by the conducting part is shorter than that defined by the supporting part.

10. The electrical contact as claimed in claim 9, wherein the main body and the secondary body are secured together.

11. The electrical contact as claimed in claim 10, wherein the secondary body forms barbs for retaining the contact in an insulative housing of the electrical connector while the main body does not.

12. The electrical contact as claimed in claim 9, wherein an upper end of the upper supporting arm abuts against the upper contacting section of the upper contacting arm, and a lower end of the lower supporting arm abuts against the lower contacting section of the lower contacting arm.

13. The electrical contact as claimed in claim 12, wherein the upper end of the upper supporting arm upwardly abuts against the upper contacting section of the upper contacting arm, and the lower end of the lower supporting arm downwardly abuts against the lower contacting section of the lower contacting arm.

14. An electrical contact for use with an electrical connector, comprising:

a conducting part including a vertical main body with a resilient upper contacting arm upwardly extending from the main body with an upper contacting section at an upper end thereof; and a supporting part including a vertical secondary body abutting against the main body with a resilient upper supporting arm upwardly extending from the secondary body thereof with an upper end abutting against the upper contacting section; wherein the conducting part and the supporting part are made from different materials, and the conducting part has a conductivity higher than the supporting part while the supporting part has a strength and resiliency higher than the conducting part; and the upper contacting arm extends from the main body in a first transverse direction while the contacting section extends backwardly in a second transverse direction opposite to the first transverse direction.

15. The electrical contact as claimed in claim 14, wherein the upper end of the upper supporting arm upwardly abuts against the upper contacting section.

16. The electrical contact as claimed in claim 14, wherein the upper supporting arm includes a first portion extending from the secondary body in the second transverse direction, and a second portion extending from the first portion in the first transverse direction with the upper end thereof.

17. The electrical contact as claimed in claim 14, wherein the secondary body forms barbs for engagement within an insulative housing of the electrical connector while the main body does not.

18. The electrical contact as claimed in claim 14, wherein the conducting part forms a horizontal groove.

19. The electrical contact as claimed in claim 14, wherein the main body is engaged with the secondary body in a parallel relation.

20. The electrical contact as claimed in claim 14, wherein the main body and the secondary body are secured together.

* * * * *